US005831653A

United States Patent [19]

Brandon et al.

[11] Patent Number: 5,831,653

[45] **Date of Patent: *Nov. 3, 1998**

[54] INK JET PRINT HEAD CARTRIDGE

[75] Inventors: Fred Young Brandon, Lexington, Ky.; Curtis Ray Droege, Centralia, Ill.; Bruce David Gibson, Lexington, Ky.; Kenneth James Harshbarger, Lexington, Ky.; James Harold Powers, Lexington, Ky.; William Michael Toon, Lexington, Ky.; John Dennis Zbrozek, Lexington, Ky.

[73] Assignee: Lexmark International, Inc., Lexington, Ky.

[ * ] Notice: The term of this patent shall not extend beyond the expiration date of Pat. No. 5,576,750.

[21] Appl. No.: 697,151

[22] Filed: Aug. 21, 1996

Related U.S. Application Data

[63] Continuation of Ser. No. 321,344, Oct. 11, 1994, Pat. No. 5,576,750.

[51] Int. Cl.[6] ..... B41J 2/175

[52] U.S. Cl. ..... 347/87

[58] Field of Search ..... 347/86, 87, 92

[56] References Cited

U.S. PATENT DOCUMENTS

| | | | |
|---|---|---|---|
| 4,368,478 | 1/1983 | Koto | 346/140 R |
| 4,549,191 | 10/1985 | Fukmchi et al. | 346/140 R |
| 4,689,641 | 8/1987 | Scardovi et al. | 346/140 R |
| 4,768,044 | 8/1988 | Shimosato et al. | 346/140 R |
| 4,771,295 | 9/1988 | Baker et al. | 347/87 |
| 4,868,585 | 9/1989 | Nishikawa et al. | 346/140 R |
| 5,119,115 | 6/1992 | Buat et al. | 347/87 |

FOREIGN PATENT DOCUMENTS

| | | | |
|---|---|---|---|
| 424133 | 4/1991 | European Pat. Off. | 347/87 |
| 0529879 A1 | 3/1993 | European Pat. Off. . | |
| 529879 | 3/1993 | European Pat. Off. | 347/87 |
| 59-120462 | 7/1984 | Japan . | |

*Primary Examiner*—Valerie Lund
*Attorney, Agent, or Firm*—Steven D. Gilliam

[57] ABSTRACT

An ink-jet printer cartridge having a center reservoir chamber and two side reservoir chambers for holding inks of three different colors is provided with ink flow pathways of special configuration for connecting the reservoir chambers to exit ports at the print element. The ink flow pathways are provided with ridges extending along substantially their entire lengths so that air bubbles cannot completely block ink flow through the pathways. The ink flow pathways are disposed such that they have a vertical component of direction over their entire length and the pathways connecting the side reservoir chambers to exit ports include duct portions disposed at compound angles relative to the axes of the cartridge so that air bubbles, because of their buoyancy, will naturally tend to drift upwardly through the inclined ducts toward the reservoir chambers during normal usage, or drift toward the exit openings when the cartridge is inverted for priming. The duct portions of the ink flow pathways are generally trapezoidal in cross-section, the side walls intersecting the top wall at acute angles so that air bubbles cannot completely block the duct portions. The duct portions have end surfaces for directing air bubbles toward the reservoir chambers during priming, the end surfaces being end faces of plugs.

19 Claims, 7 Drawing Sheets

INK JET PRINT HEAD CARTRIDGE

This Application is a Continuation of U.S. patent application Ser. No. 08/321,344, filed Oct. 11, 1994, now U.S. Pat. No. 5,576,750, entitled Reliable Connecting Pathways For A Three-Color Ink-Jet Cartridge.

FIELD OF THE INVENTION

The present invention relates to cartridges for ink-jet printers, and more particularly to cartridges having ink flow pathways extending from ink reservoir chambers to a print element and configured so that the pathways are easily primed during a cartridge fill operation, are insensitive to the presence of air bubbles during normal operation, and can withstand shocks incurred during transportation and handling.

BACKGROUND OF THE INVENTION

Many currently available color ink-jet printers employ a cartridge having an ink reservoir divided into three distinct chambers, each chamber holding ink of one of three primary colors. Architecturally, such color cartridges are more complicated than monochrome cartridges because the ink flow pathways from the three chambers must converge into a very small region at the print element. The fabrication process often dictates constraints on the basic functional requirements of the pathways. Such constraints can lead to a pathway design wherein it is difficult to prime the pathways during initial ink fill, or a design which will not function reliably when air bubbles are ingested during normal handling and operation.

It is known that air bubbles, because they assume a nearly spherical shape, can be prevented from completely blocking an ink flow pathway by providing the pathway walls with irregularities. EP application no. 92-307379.5, suggests ink flow pathways having grooves in the walls. However, the provision of grooves in the pathways causes problems in the making of the cartridge body. The grooves and ink flow pathways are formed in the cartridge body as the cartridge body is molded. To form the grooves, the mold tool must have a mold core pin with ridges conforming to the widths of the grooves. The grooves are very narrow hence the width of the ridges on the core pin must be quite small and may be easily damaged. Furthermore, molds are frequently polished during final conditioning and ridges on the core pin interfere with polishing the core pin.

A further disadvantage of grooves is that they must extend to an outer surface of the cartridge body so that the core pin carrying the ridges which form the grooves, may be withdrawn from the pathway.

SUMMARY OF THE INVENTION

An object of the present invention is to provide a cartridge body having ink flow pathways configured so as to avoid the manufacturing problems of the prior art while at the same time providing reliable ink flow during normal use and easier priming.

An object of the invention is to provide an ink-jet printer cartridge body having ink flow pathways disposed at compound angles with respect to the natural axes of the cartridge body.

Another object of the invention is to provide a cartridge body having ink flow pathways extending from ink reservoir chambers to exit ports, the pathways having a vertical component of direction throughout their entire length.

A further object of the invention is to provide a cartridge body having ink flow pathways extending from ink reservoir chambers to exit ports, the pathways having walls with ridges extending into the pathways, the ridges extending substantially the entire length of the pathways.

Still another object of the invention is to provide an ink-jet printer cartridge body having a center ink reservoir chamber connected by a first ink flow pathway to a first exit port and second and third ink reservoir chambers disposed on opposite sides of the center ink reservoir chamber and connected to second and third exit ports by second and third ink flow pathways, the second and third ink flow pathways having portions of generally trapezoidal cross-section with side walls intersecting top walls at acute angles.

Yet another object of the invention is to provide a cartridge body as described above having plugs for closing one end of each of the portions of generally trapezoidal cross-section, the plugs each having two end surfaces forming obtuse angles with each other, one of the end surfaces forming an obtuse angle with a bottom wall of one of the portions of generally trapezoidal cross-section.

Other objects and advantages of the invention and the manner of making and using it will become obvious upon consideration of the following description and the accompanying drawings.

DESCRIPTION OF THE INVENTION

In the following description, the words "above", "below", "upwardly", "downwardly", "vertical", "horizontal", "top" and "bottom" are used as words of description rather than words of limitation since some ink-jet cartridges may be disposed in different orientations depending upon the specific printer in which they are used.

Figure 1:
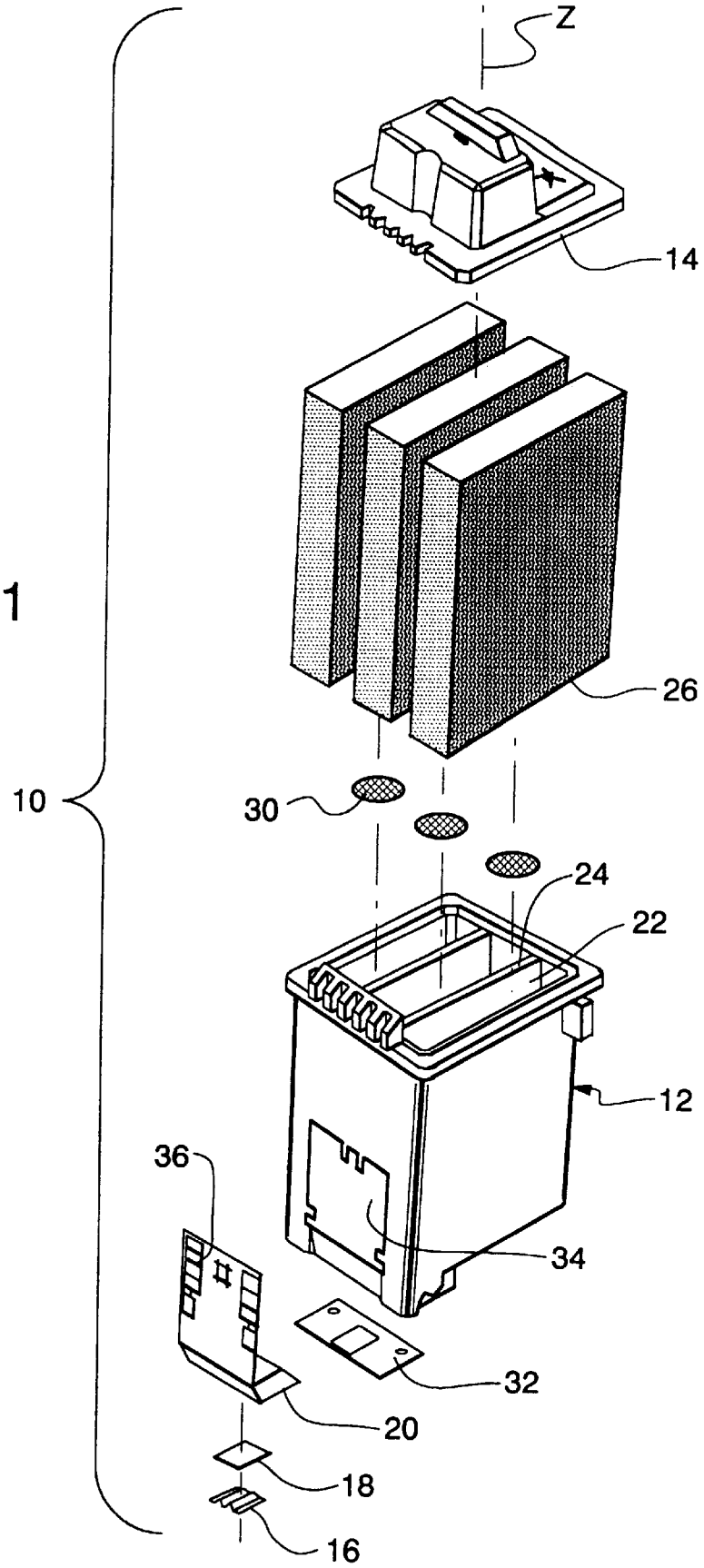
FIG. 1 is an exploded view of a tri-color ink-jet cartridge in which the invention is utilized.
Figure 2:
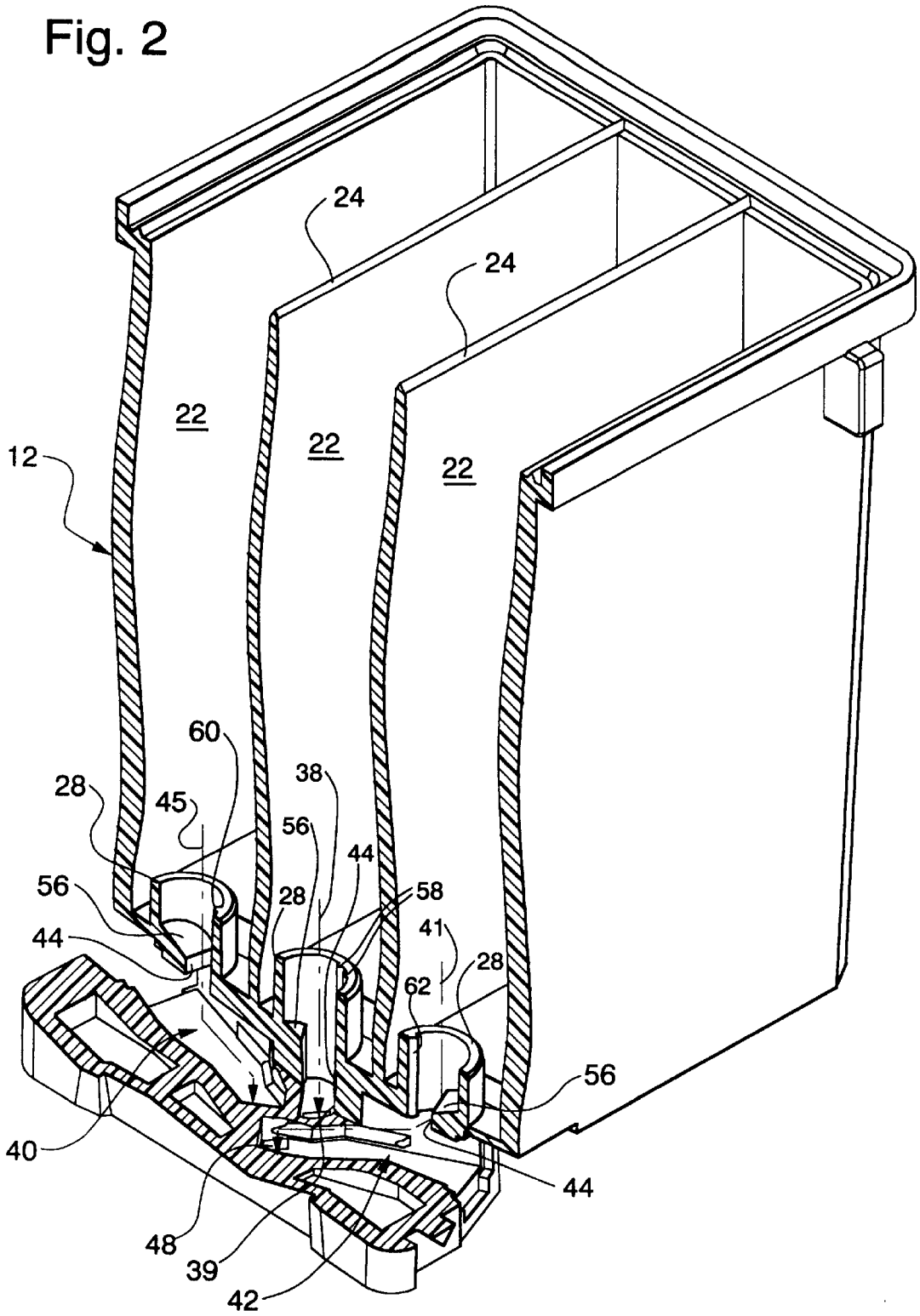
FIG. 2 is a perspective view of the cartridge body with a portion cut away to show the connecting ducts and standpipes.
Figure 6:
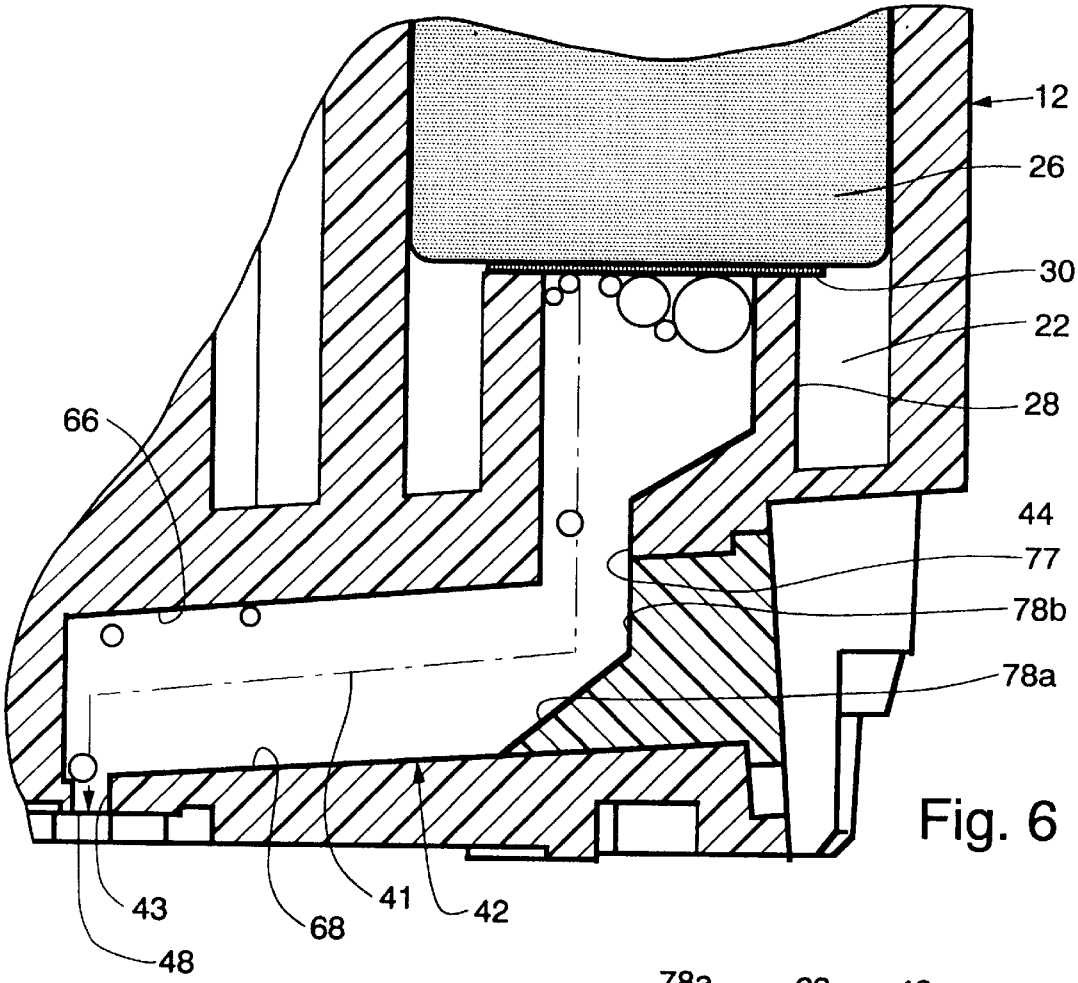
FIGS. 6 and 7 are sectional views taken vertically through an ink flow path and illustrating the movement of air bubbles through the ink flow pathway when the cartridge is in use (FIG. 6) and when it is being primed (FIG. 7); and, FIGS. 8 and 9 are side and bottom views, respectively showing the orientation of the axes of the connecting ducts relative to the natural axes of the cartridge body.

Referring now to FIGS. 1 and 2, a tri-color ink-jet cartridge or pen 10 comprises a cartridge body 12, a lid 14, a nozzle plate 16, a heater 18 and a tab circuit 20. The cartridge body 12 has a hollow interior divided into a center and two side ink reservoir chambers 22 by two dividing walls 24. Three blocks of foam material 26 are disposed in the reservoir chambers and the chambers are each filled with an ink of a different color. At the bottom of each reservoir chamber 22 is a standpipe 28 and the top of each standpipe is covered, as shown in FIG. 6, with a filter 30 for filtering the ink as it is sucked from a chamber.

The tab circuit 20 is attached to the bottom and front surface of cartridge body 12 by two adhesive preforms 32, 34. The tab circuit carries terminals 36 by means of which electrical signals are applied to control ejection of ink through nozzles in nozzle plate 16. As is well known in the art, inks in the reservoir chambers 22 are sucked out of the chambers through filters 30 and the stand pipes 28 when the nozzles are fired.

The cartridge body 12 is formed with three ink flow pathways or passages (indicated by broken lines 38, 41 and 45 in FIG. 2), the pathways extending from reservoir chambers 22 to three exit ports 46, 48 and 50 (FIG. 3) located within a recess 52 in the bottom surface 54 of the cartridge body. It will be understood that the nozzle plate 16 and heater 18 comprise a print means and are mounted to the surface 54 so that the three colored inks available at openings 46, 48 and 50 may be selectively ejected through groups of nozzles in the nozzle plate to cause printing in a conventional manner.

The bottoms of standpipes 28 are partially closed by sloping bottom surfaces 56 (FIG. 2) so that the openings 44 of approximately semi-circular configuration are formed in the bottoms of the standpipes. The first ink flow pathway 38 extends from the center ink reservoir chamber 22 to exit port 46 and includes the center standpipe 28 and a short ink feed tube 39, the ink feed tube 39 extending parallel to the vertical or Z axis (FIG. 1) of the cartridge between opening 44 and exit port 46. Two ridges 58 are provided which extend along the entire length of the interior walls of the center standpipe 28 and feed tube 39. These ridges serve to wick ink from center chamber 22 and also prevent air bubbles from completely blocking the feed tube or standpipe.

Figure 4:
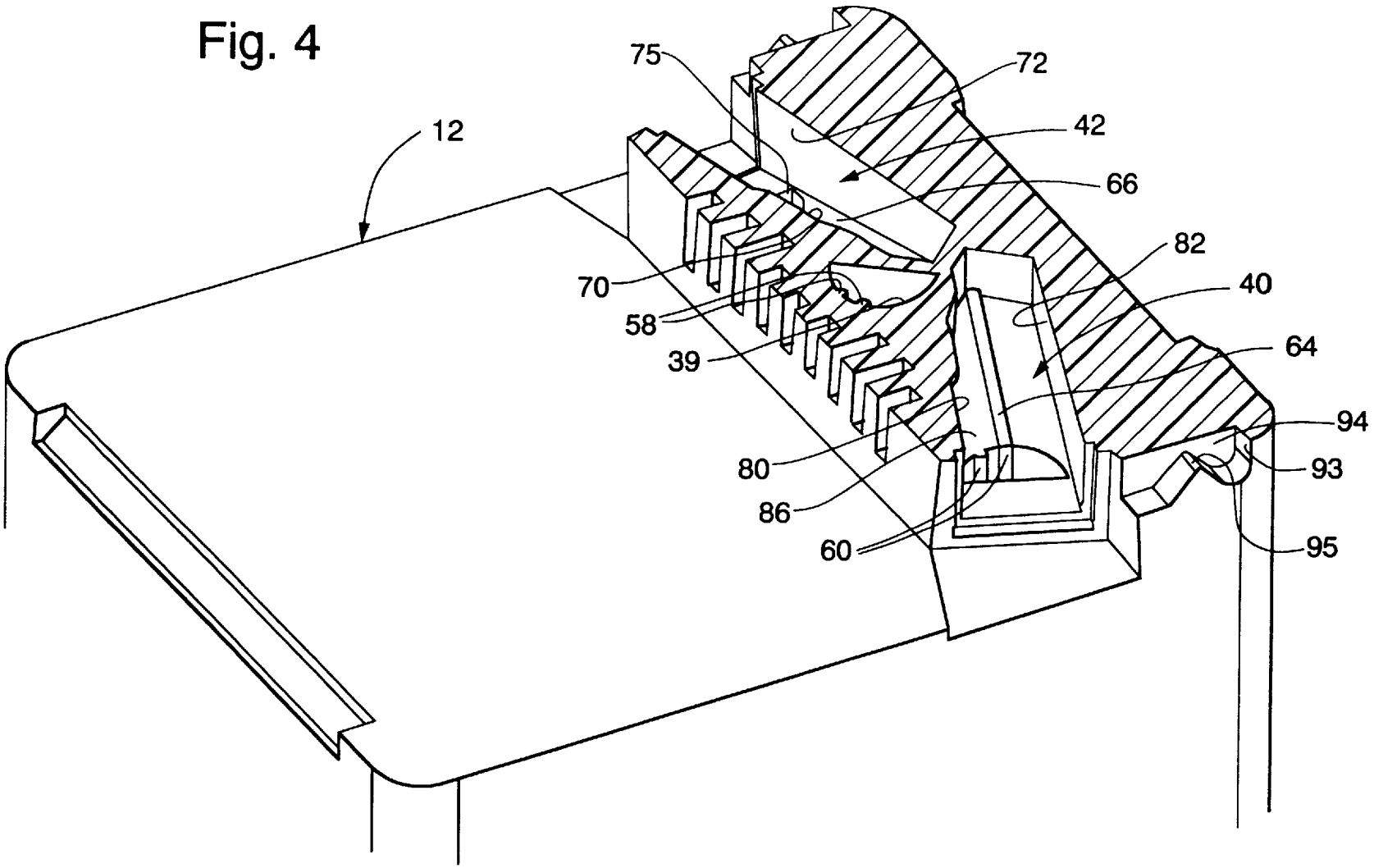
FIG. 4 is a sectional perspective view of the cartridge body looking upwardly into the ink flow pathways.

The standpipes 28 for the side reservoir chambers 22 are also provided with ridges 60 and 62, respectively, extending vertically along the entire length of the interior walls of the standpipes. Only one ridge 60 and one ridge 62 is visible in FIG. 2 although the two ridges 60 for the left side standpipe of FIG. 2 are visible in FIG. 4. As shown in FIG. 4, which is a view looking upwardly toward standpipe openings 44, one of the ridges 60 joins with a ridge 64 that extends along the entire length of the top wall 86 of a duct 40.

The second ink flow pathway 41 extends from the right side ink reservoir chamber 22 of FIG. 2 to the exit port 48. The second pathway includes the right-hand standpipe 28 of FIG. 2, a duct portion 42 (FIGS. 4 and 5) and a short feed tube 43 (FIG. 6).

Figure 5:
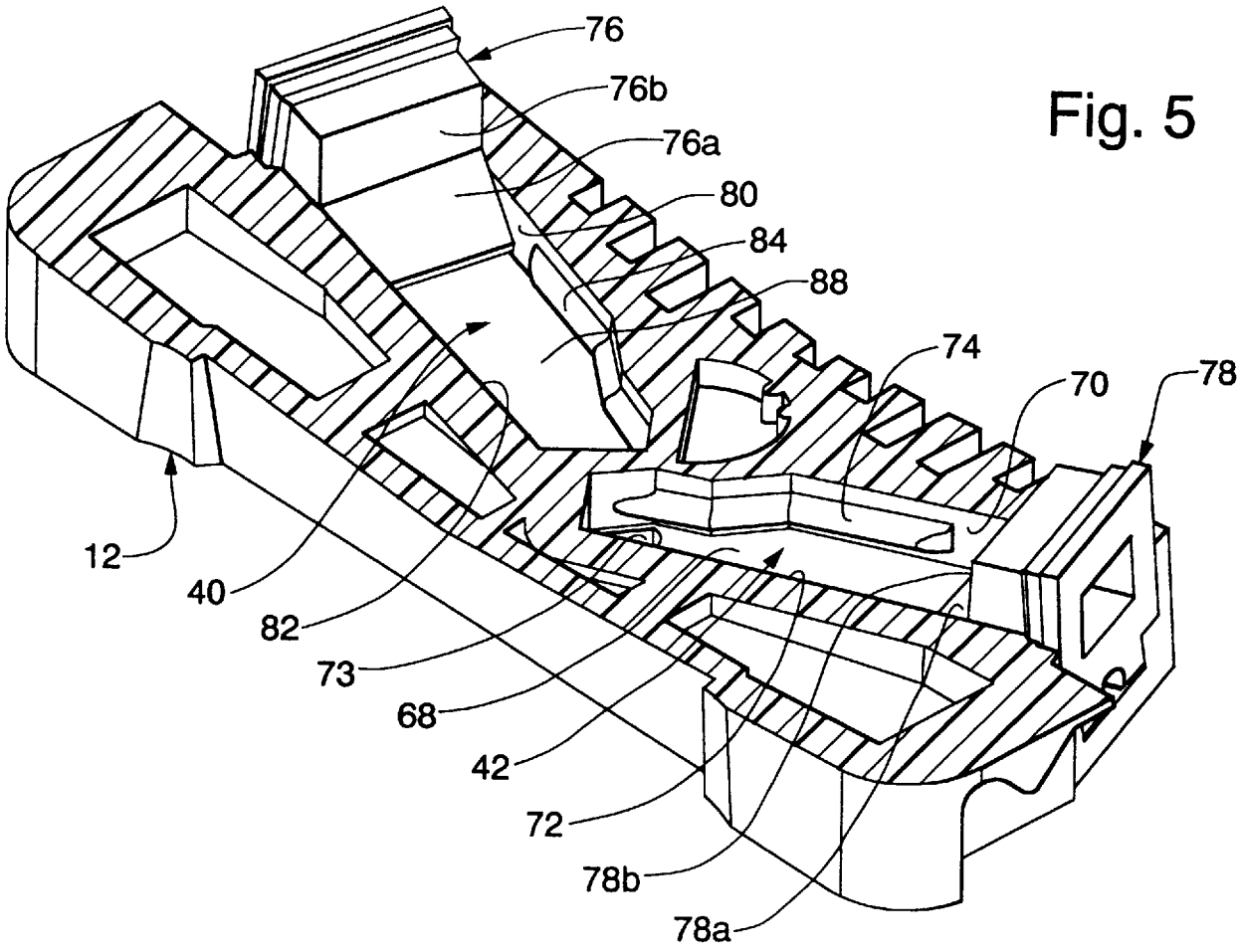
FIG. 5 is a perspective view, partly in section, showing details of the connecting ducts.

Duct portion 42 is irregular in shape as shown in FIGS. 4 and 5. The duct is bounded by a top wall 66, a bottom wall 68, and two side walls 70 and 72. The side walls 70 and 72 converge to close one end of the duct, the point of convergence being slightly beyond where feed tube 43 joins an opening 73 in the bottom wall. Ink from the right standpipe 28 of FIG. 2 enters the duct 42 through an opening 75 in top wall 66. As shown in FIG. 6, standpipe opening 44 is connected with opening 75 by a short passage 77.

The duct 42 is generally trapezoidal in cross-section. Side walls 70 and 72 intersect top wall 66 at acute angles. Since air bubbles assume nearly spherical shapes they will not nest into the acute angles hence they cannot completely block the flow of ink through the duct.

A ridge 74 is provided on the side wall 70. The ridge 74 extends along the wall at least over the distance traversed by ink flowing into the duct through opening 75 and exiting from the duct through opening 73. A second ridge, not visible in the drawing but similar to ridge 64 in duct 40, extends along top wall 66. The ridges are provided to impart further irregularity to the interior walls of duct 42 so that air bubbles cannot completely block ink flow through the duct.

Figure 3:
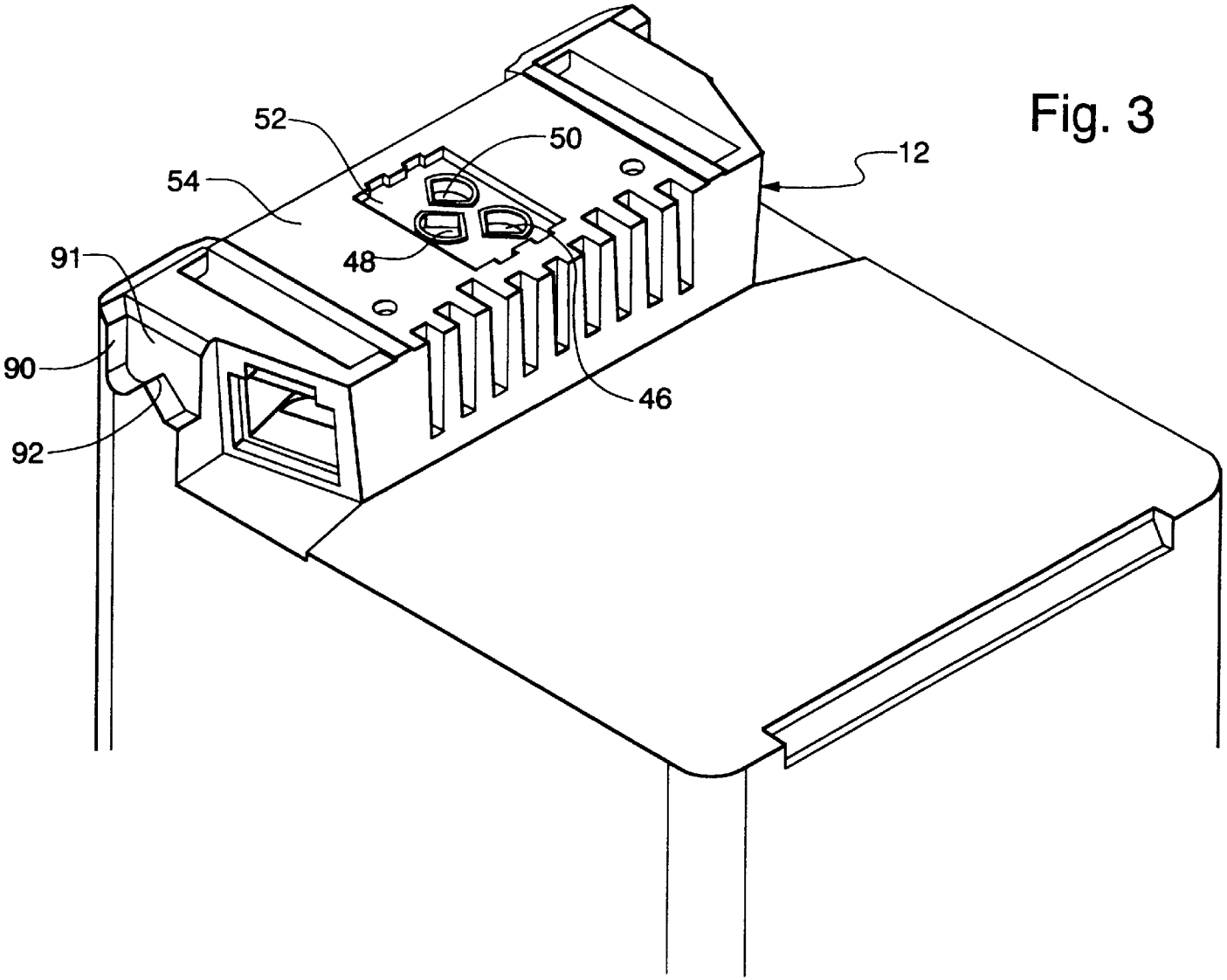
FIG. 3 is a perspective view of the bottom portion of the cartridge body showing the exit ports through which ink exits from the cartridge body.

The third ink flow pathway 45 connects the left ink reservoir chamber 22 to the exit port 50 (FIG. 3). The pathway 45 is similar to the pathway 41 and will not be described in detail except to note that it includes a duct portion 40 provided with side walls 80 and 82 intersecting a top wall 86 at acute angles, a ridge 84 on the side wall 80 and a further ridge 64 on the top wall.

Figure 7:
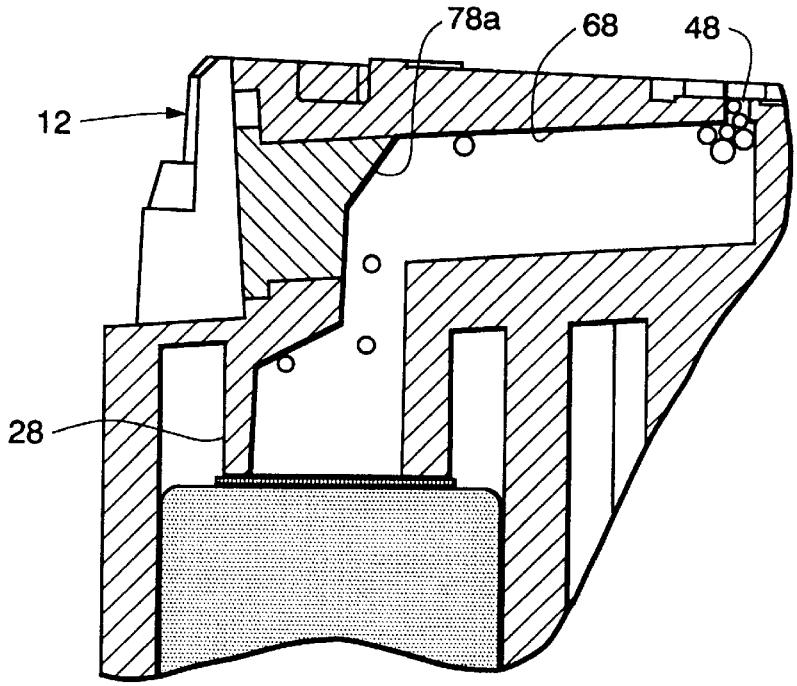

The cartridge body 12 may be molded as a monolithic body of plastic material as explained in the pending application of DeFosse et al. Ser. No. 08/165,691, assigned to the same assignee as the present application. In order to mold the duct portions 40 and 42 it is necessary to provide an opening through which the core pin of-the mold tool may be withdrawn after the cartridge body is formed. After the core pin is withdrawn, plugs are provided for closing the openings. FIG. 5 shows plugs 76 and 78 for closing an end of ducts 40 and 42, the plugs 76 and 78 differing from those disclosed in the DeFosse et al. application in that they have sloping surfaces 76*a*, 78*a* joining surfaces 76*b*, 78*b* at obtuse angles. In addition, surfaces 76*a* and 78*a* define obtuse angles with the bottom walls 68 and 88 of duct portions 40 and 42. As best seen in FIGS. 6 and 7, this surface arrangement avoids a corner in which air bubbles might collect and at the same time provides surfaces for directing air bubbles to the standpipe 28 during normal usage or to the pathway exit port when the cartridge is being primed.

Figure 8:
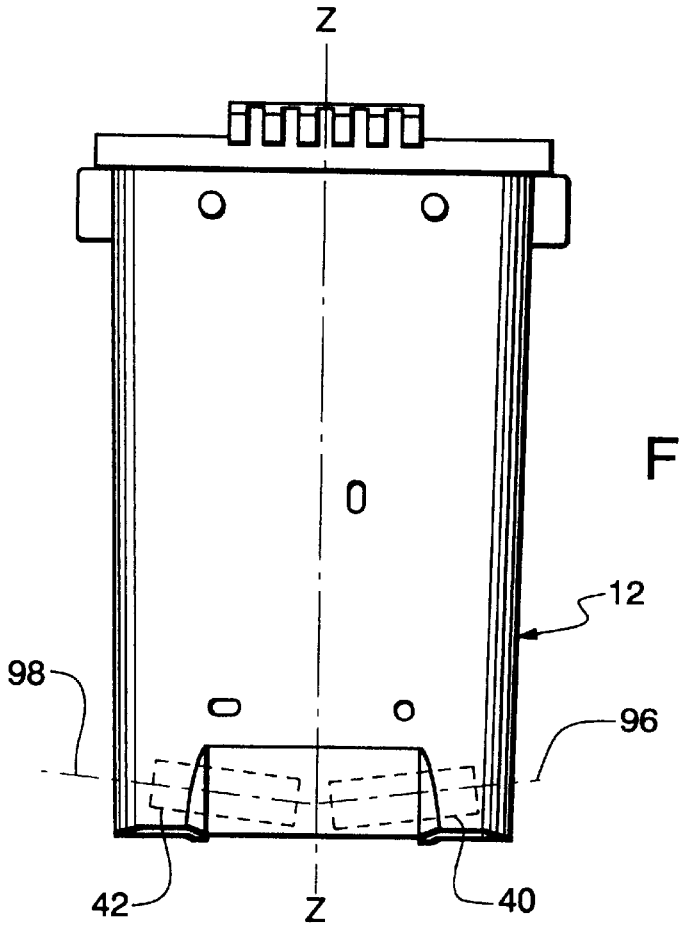
Figure 9:
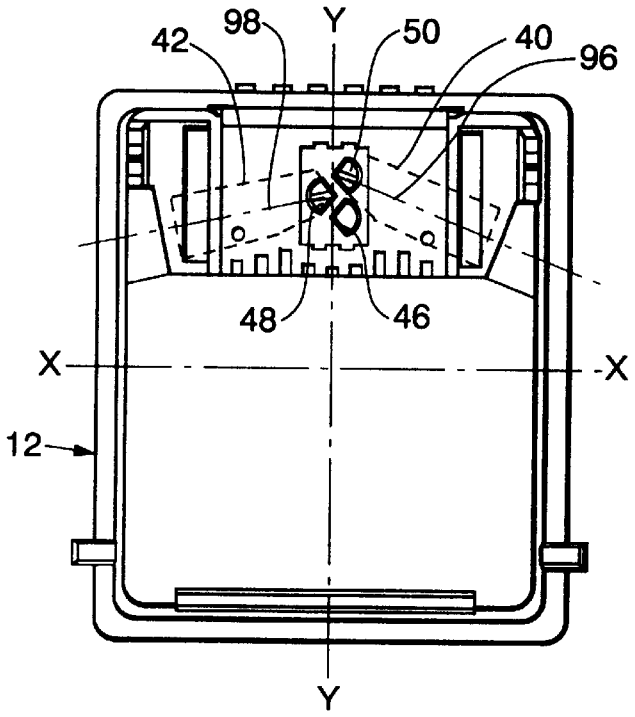

It is a feature of the invention that the ducts 40 and 42 are disposed at compound angles relative to the natural axes of the cartridge body 12. That is, the axes 96 and 98 of the ducts are disposed at an angle to the X and Y axes as shown in FIG. 9 and also disposed at an angle with respect to the Z axis as shown in FIG. 8. That is, the axes 96 and 98 of ducts 40 and 42 extend at acute angles, greater than zero, with respect to the X-Y, X-Z and Y-Z planes in which pairs of the axes X, Y and Z lie. The horizontal angle components provide the necessary degree of freedom required to maximize the cross-sectional area of the ink flow pathway 38 connected to the center reservoir chamber. The horizontal angles also provide a degree of flexibility in positioning the standpipes 28 in the outer reservoir chambers. This is important in that the positioning of these standpipes must satisfy certain design requirements dictated by a foam stuffing operation in which the foam blocks 26 are stuffed into the reservoir chambers 22.

The vertical angle component is provided to take advantage of the natural buoyancy of air bubbles in the ink. FIG. 6 shows the ink flow pathway 41 for the right side reservoir chamber 22 when it is in the normal or printing orientation. It will be noted that the pathway has a vertical component of direction over its entire length from the exit port 48 to the reservoir chamber 22. Because the pathway has an upward inclination from the opening 48, air bubbles entering the opening will tend to float upwardly, move along the top wall 66, and then move upwardly through the stand pipe 28 into reservoir chamber 22 where they can cause no harm.

The vertical angle component also aids in initially priming a cartridge after it has been filled with ink. In a typical priming operation, the cartridge is inverted (FIG. 7) and a suction cup is placed over the nozzle plate to suck air bubbles out of the ink flow pathways through the exit ports. It is evident from FIG. 7 that when the cartridge is inverted, the air bubbles will float upwardly and move along the bottom (now on top) surface 68 of duct portion 42 to the exit port 48.

Since the ink flow pathway 45 is similar to ink flow pathway 41, air bubbles in pathway 45 will similarly migrate to an ink reservoir chamber 22 during normal use and to the exit port 50 when the cartridge is inverted for priming. The center ink flow pathway 38 is substantially vertically oriented hence air bubbles will readily float upwardly, either into the center reservoir chamber during normal use or out of exit port 46 during priming.

Arrangement of the duct portions 41 and 45 so that they have axes at a compound angle relative to the natural axes of the cartridge body yields a further advantage not directly related to ink flow. The surfaces 90, 91 and 92 (FIG. 3) and the surfaces 93, 94 and 95 (FIG. 4) are critical surfaces in that they are surfaces which position the cartridge relative to a carrier which moves the cartridge for printing. By arranging the duct portions 40 and 42 at compound angles relative to the natural axes of the cartridge body the outer ends of the duct portions are spaced further from the critical surfaces so that there is less chance of deforming the critical surfaces as the plugs 76, 78 are welded into the open ends of the duct portions.

From the foregoing description it is seen that the present invention provides an improved cartridge body for a tricolor ink-jet printer, the cartridge body being characterized in that (1) ink flow pathways therein have duct portions disposed at compound angles relative to the natural axes of the cartridge body so that all pathways have a vertical component of direction throughout their entire length, (2) the ink flow passages have ridges over substantially their entire length to prevent complete blockage of ink flow by air bubbles entering the pathways, and (3) the duct portions are generally trapezoidal in cross-section with side walls intersecting top walls at acute angles so that air bubbles cannot completely block the ducts. These features result in a cartridge body which is simpler than prior art cartridge bodies to manufacture, provides more reliable ink feed during normal use, and is easier to prime.

While a preferred embodiment has been described in specific detail by way of illustration, it will be obvious that various modifications and substitutions may be made in the form and details of the described embodiment without departing from the spirit and scope of the invention as defined by the appended claims.

We claim:

1. An ink-jet printer cartridge body having a lid, ink, a center ink reservoir chamber connected by a first ink flow pathway to a first exit port and second and third ink reservoir chambers disposed on opposite sides of said center ink reservoir chamber and connected to second and third exit ports by second and third ink flow pathways, said second and third ink flow pathways having portions of generally trapezoidal cross-section, and plugs for closing one end of each of said portions of generally trapezoidal cross-section, said plugs each having two end surfaces forming obtuse angles with each other, one of said end surfaces forming an obtuse angle with a bottom wall of said portion of generally trapezoidal cross-section.

2. An ink-jet printer cartridge body as claimed in claim 1 wherein said portions of said second and third ink flow pathways have side walls intersecting a top wall at acute angles.

3. An ink-jet printer cartridge body as claimed in claim 1 wherein said first, second and third ink flow pathways have walls with ridges extending inwardly into said pathways said ridges extending substantially the entire length of said pathways.

4. An ink-jet printer cartridge body as claimed in claim 1 wherein said first, second and third ink reservoir chambers are disposed above said exit ports and said first, second and third ink flow pathways have a downward component of direction along their entire length.

5. An ink-jet printer cartridge body as claimed in claim 1, wherein at least one member selected from the group consisting of said lid and said ink is removable from said cartridge body.

6. An ink-jet printer cartridge body, comprising:

a lid;

ink;

a center ink reservoir chamber;

first and second side ink reservoir chambers arranged side by side with said center reservoir chamber in the direction of an X axis of said body;

first, second and third exit ports disposed in a plane parallel to an X-Y plane in which X and Y axes of said body lie, said exit ports being disposed to permit ink flow from said body in a direction parallel to a Z axis of said body; and, first, second and third ink flow pathways, said first and second ink flow pathways connecting said first and second side ink reservoir chambers to said first and second exit ports, respectively, and said third ink flow pathway connecting said center ink reservoir chamber to said third exit port, said first and second ink flow pathways having duct portions, the axes of said duct portions extending in directions at acute angles, greater than zero, with respect to said X-Y plane, an X-Z plane and a Y-Z plane, where said X-Z plane is a plane in which said X and Z axes lie, and said Y-Z plane is a plane in which said Y and Z axes lie.

7. An ink-jet printer cartridge body as claimed in claim 6, wherein at least one member selected from the group consisting of said lid and said ink is removable from said cartridge body.

8. An ink-jet printer cartridge body as claimed in claim 6, wherein said duct portions extend to first and second openings, respectively, in opposite sides of said body.

9. An ink-jet printer cartridge body as claimed in claim 6, wherein said first and second pathways each includes a standpipe positioned in one of said side reservoir chambers, and a feed tube terminating at one of said first and second exit ports, said duct portions connecting a respective standpipe to a respective feed tube, said duct portions having generally flat side walls intersecting a flat top wall at acute angles, whereby any air bubbles entering said duct portions cannot completely block the flow of ink through said duct portions.

10. An ink-jet printer cartridge body as claimed in claim 9, wherein said third ink flow pathway includes a standpipe positioned in said center reservoir chamber, and a feed tube terminating at said third exit port, the standpipe and the feed tube of the third ink flow pathway being axially aligned in a direction parallel to said Z axis.

11. An ink-jet printer cartridge body as claimed in claim 6, wherein said duct portions have flat side walls with ridges extending from said side walls into said first and second pathways to prevent blockage of said first and second pathways by any air bubbles passing through said first and second pathways.

12. An ink-jet printer cartridge body as claimed in claim 11, wherein said duct portions have flat top surfaces and at least one ridge extending from each top surface into said first and second pathways.

13. An ink-jet printer cartridge body as claimed in claim 11, wherein said ridges extend into the standpipes and the feed tubes.

14. An ink-jet printer cartridge body as claimed in claim 13, wherein said cartridge body comprises a monolithic body of plastic material.

15. An ink-jet printer cartridge body having therein:

a lid;

ink;

a center ink reservoir chamber;

first and second side ink reservoir chambers disposed on opposite sides of said center ink reservoir chamber;

a standpipe in each of said ink reservoir chambers;

first, second and third exit ports disposed in a plane and permitting ink flow from said body;

a first ink flow pathway connecting the standpipe in the center reservoir chamber to said third exit port; and, second and third ink flow pathways connecting the standpipes in the first and second side ink reservoir chambers to the first and second exit ports, respectively, said second and third ink flow pathways each including a linear duct portion disposed so as to have a component of direction parallel to natural X, Y and Z axes of said body.

16. An ink-jet printer cartridge body as claimed in claim 15, wherein at least one member selected from the group consisting of said lid and said ink is removable from said cartridge body.

17. An ink-jet printer cartridge body as claimed in claim 15, wherein the duct portions of the second and third ink flow pathways extend to first and second openings in first and second side surfaces, respectively, of said body.

18. An ink-jet printer cartridge body as claimed in claim 17, wherein said body is a monolithic body of plastic material, and said duct portions are bounded by substantially planar surfaces having ridges protruding therefrom into the ink flow pathways.

19. An ink-jet printer cartridge body as claimed in claim 17, in combination with first and second plugs for closing said first and second openings.

* * * * *